United States Patent [19]

Ruffieux et al.

[11] 4,286,128

[45] Aug. 25, 1981

[54] ELECTRIC GAS-SWITCH

[75] Inventors: Stanislaus Ruffieux, Baden; Ekkehard Schade, Wettingen, both of Switzerland

[73] Assignee: BBC Brown, Boveri & Company Ltd., Baden, Switzerland

[21] Appl. No.: 897,150

[22] Filed: Apr. 17, 1978

[30] Foreign Application Priority Data

Apr. 29, 1977 [CH] Switzerland ..... 5349/77

[51] Int. Cl.[3] ..... H01H 33/70; H01H 33/82

[52] U.S. Cl. ..... 200/148 R; 200/147 R; 200/148 B

[58] Field of Search ..... 200/147 R, 147 A, 147 AA, 200/148 A, 150 G, 149 R, 149 A, 149 B, 150 D, 151, 148 R, 148 B

[56] References Cited

U.S. PATENT DOCUMENTS 3,140,374 7/1964 Cole ..... 200/151 X 3,984,651 10/1976 Lewis ..... 200/149 A X

FOREIGN PATENT DOCUMENTS 574673 4/1976 Switzerland .

*Primary Examiner*—James R. Scott

*Attorney, Agent, or Firm*—Burns, Doane, Swecker & Mathis

[57] ABSTRACT

An electric gas-switch includes a switching chamber that is divided by a partition into an arc chamber and an additional chamber with a central pin being located within the arc chamber. The pin is embraced at least partially by a stationary switch part which is surrounded by a coil through which is flowing a cut-off current. One end of the coil is connected with an annular intermediate electrode which surrounds the central pin at a distance within the region of its free end. In an on position the central pin is embraced, at least at its free end, by the movable switch part that is designed in the form of a nozzle.

9 Claims, 5 Drawing Figures

ELECTRIC GAS-SWITCH

BACKGROUND AND SUMMARY OF THE INVENTION

The present invention relates generally to an electric switch and more specifically relates to an electric gas switch having a switching chamber divided into portions.

Swiss Pat. No. 574,673 issued to Stanislaus Ruffieux and Ekkehard Schade on May 15, 1976 discloses and electric gas-switch where the arc provides an internal pressure generation. Furthermore, the switch includes a device to influence the arc magnetically in order to improve the circuit-breaking capacity and to simplify the construction of the switch. In this way, the manufacture of the switch is made more economical. The switch utilizes a central pin which is made at least partially of a material such as graphite. The arc which is produced at the time of cut-off by the switch is divided by the central pin into both a rotating hot arc and an arc which in the course of the cut-off process is lengthening and also cooled by the quenching flow. In this way, the circuit-breaking capacity of the switch is intended to be improved.

In order to insure a subdivision of the arc, the central pin must have a sufficient length. Accordingly, a correspondingly large travel by the movable switch part is required. Furthermore, it is necessary in an arrangement utilizing an electrically conductive and insulated arranged central pin to consider that no specifically defined intermediate potentials exist when commutating the arc from the stationary switch part to the annular intermediate electrode. In addition an annular insulative part is placed between the stationary switch part, designed in tulip-shape, and the annular intermediate electrode. The annular insulative part could possibly influence the commutation discussed above.

It is the aim of the invention to further simplify the switch construction of electrical gasswitches of the above type, or to reduce, by eliminating at least one switch part being in contact with the arc, the areas of the switch which are subjected to a direct influence by the arc, and to simultaneously improve the arc commutation.

The invention overcomes the problems in the prior art by having the central pin made from an electrically insulating material. A comparison between the arrangement of the present invention and a switch such as is disclosed by Swiss Pat. No. 574,673 shows that the central pin, used by the latter, consists of an electrically conductive material and is fastened by way of an insulative part to the terminal flange. However, in the case of the gas-switch of the present invention, the central pin which is made of an electrically conducting material is omitted or alternatively replaced respectively by an insulative pin.

It will be particularly advantageous if the central pin is designed in such manner that it will taper at its free end. The primary advantage of the invention is to improve a heating of the gas filling the switch to result in a more economic operation of the gas-switch. The switch is not only of a simpler construction than the known comparable systems but can also be made smaller in size than can the known arrangements. Additional advantages are mentioned below in connection with the explanation of the invention.

BRIEF DESCRIPTION OF THE DRAWINGS

A specific embodiment of the present invention is illustrated in the accompanying drawings wherein like reference numerals refer to like members and wherein.

Figure 1:
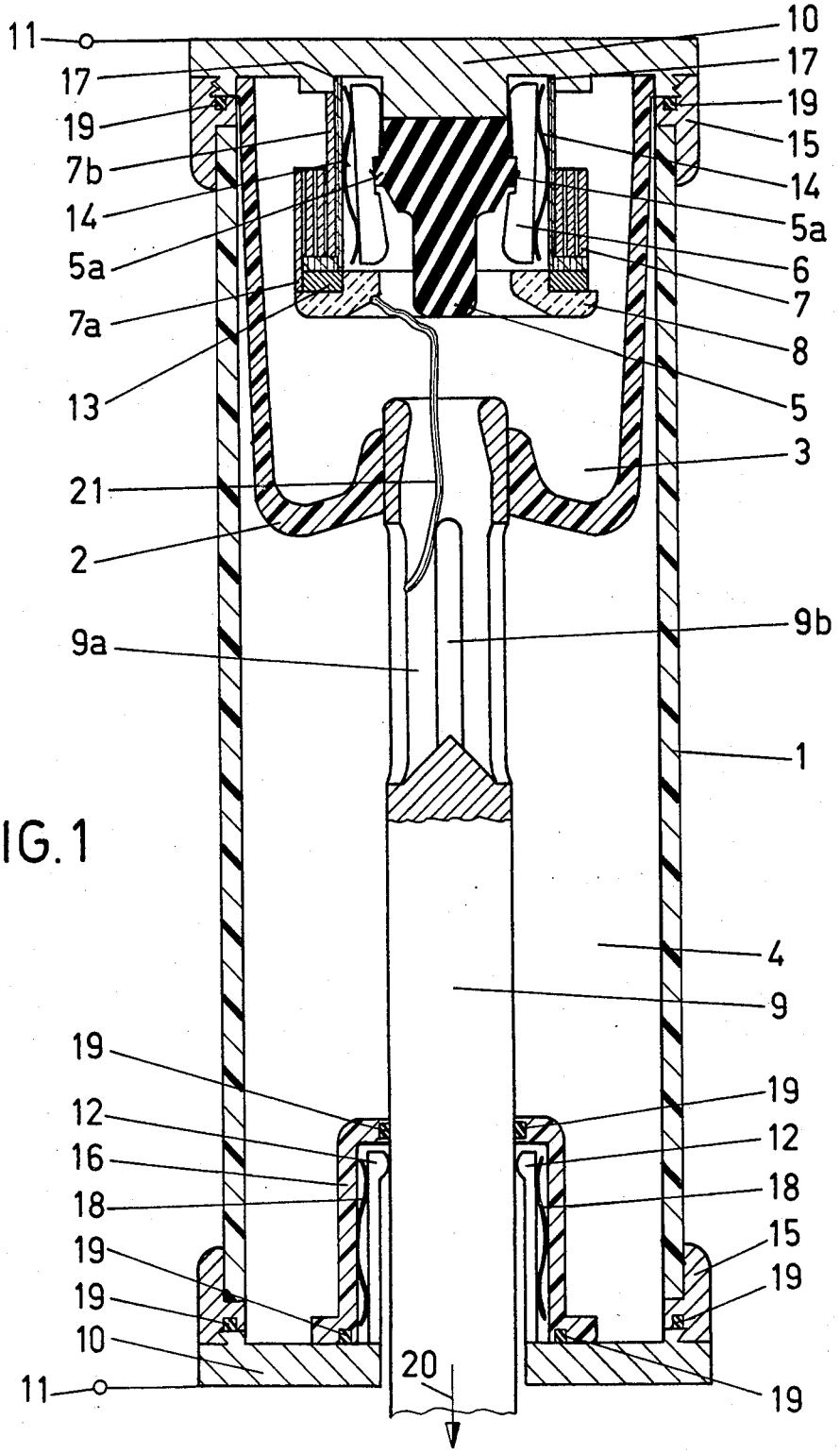
FIG. 1 is a cross sectional view of an electric gas-switch at an instantaneous switch position with an arc which is already commutated.
Figure 2A:
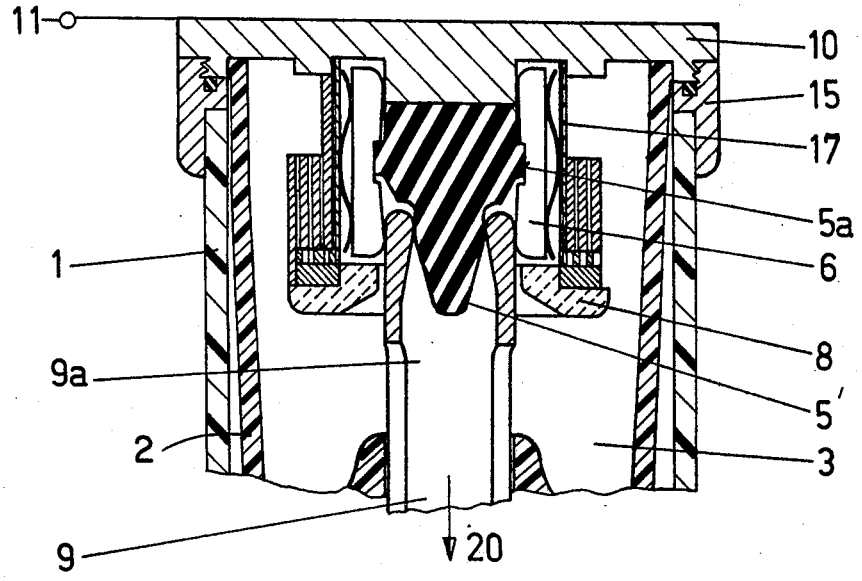
Figure 2B:
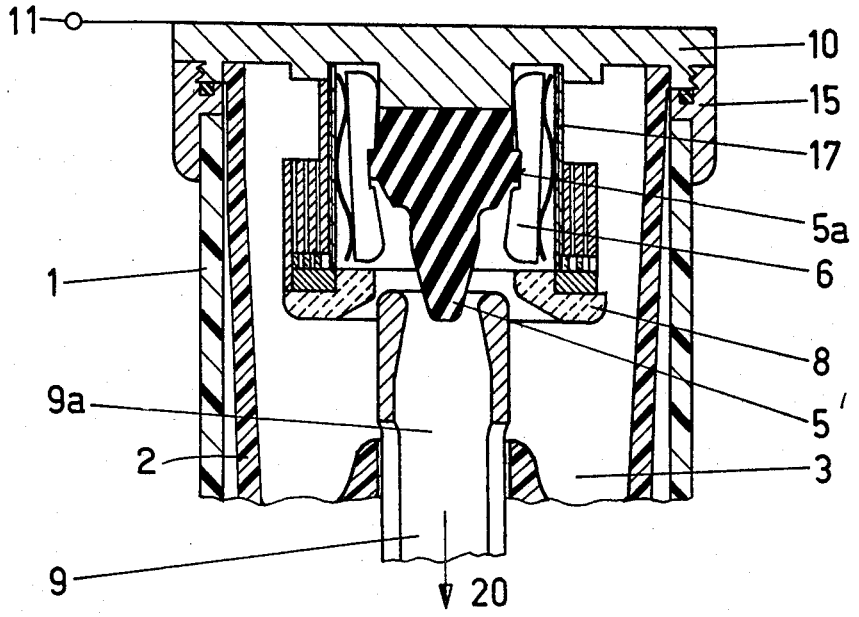
Figure 2C:
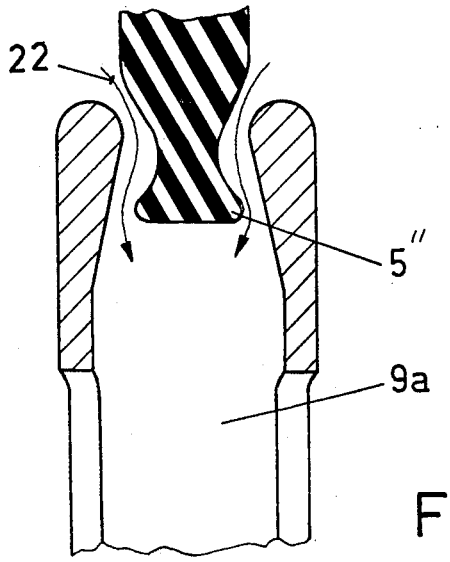
Figure 2D:
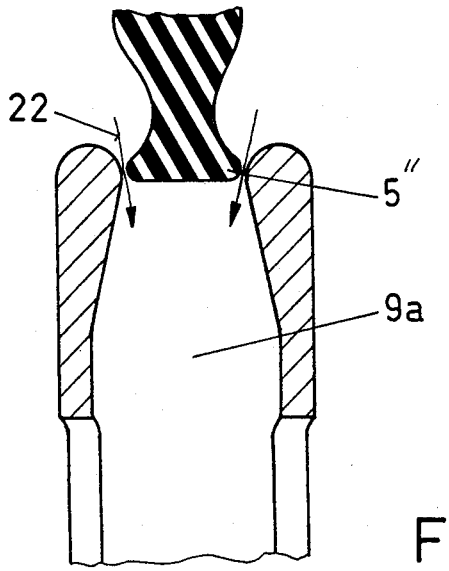

FIG. *2a* is a partial cross sectional view of the switch of FIG. 1 with a stationary switch part and an insulative pin engaging a movable switch part;

FIG. *2b* is a partial cross sectional view of the switch of FIG. 1 with an opening of a nozzle of the moving switch part being partially uncovered by the insulative pin;

FIG. *2c* is an enlarged partial cross sectional view of an insulative pin which tapers partially at its free end and with a profile of its free end increasing so that the insulative pin in cooperation with the movable switch will initially provide a nozzle with a relatively large cross section upon the opening of the gas-switch; and FIG. *2d* is another cross sectional view of the insulative pin of FIG. *2c* wherein a nozzle with a relatively smaller cross section is provided prior to the complete opening of the free end of the nozzle.

BRIEF DESCRIPTION OF THE PREFERRED EMBODIMENT

With reference to FIG. 1, a switching chamber 1 is divided by a partition 2 into an arc chamber 3 and an additional chamber 4. A central pin 5 having a cylindrical shape is located within the arc chamber 3, and is embraced at least partially by a stationary switch part 6. The switch part 6 is surrounded by a coil 7 through which a cut-off current will flow. One end *7a* of the coil is connected with an annular intermediate electrode 8 which surrounds the central pin 5 at a distance in the region of its free end. The central pin 5 is embraced, when in an on-position, at least at its free end by a movable switch part 9 which is designed, at least on the pin-facing side, in the form of a nozzle *9a*. The portion of the nozzle *9a* which projects into the additional chamber 4 is provided with a plurality of apertures *9b* extending lengthwise in the direction of the nozzle axis.

The switching chamber 1 is closed off at its two front sides by terminal flanges 10. The movable switch part 9 travels in a sealed manner through the terminal flange 10 which also closes off the additional chamber 4. The movable part 9 is guided by the partition 2 of the switching chamber 1.

The stationary switch part 6 is designed in the form of a tulip-shaped contact and is electrically connected with one of the current supply lines 11 by way of the coil-facing terminal flange 10. At the point of entry of the switch part 9 into the switching chamber 1 a sliding contact 12 is arranged at the switch-part-facing terminal flange 10. The movable switch part 9 slides along the contact 12 for the passage of current from the other supply line 11. The end of the movable contact piece 9 which faces the sliding contact part is moved in a manner known per se by driving means (not illustrated).

The partition 2 which serves both to subdivide the switching chamber 1 and to guide the movable switch part 9 is arranged so that the additional chamber 4 which acts as an area for the collection of the switch gases, has a substantially greater volume than does the arc chamber 3. The central pin 5 is attached, together with the parts 6, 7 and 8, at the terminal flange 10 that is not penetrated by the movable switch part 9. Another end of the coil 7 which connects the coil electrically with the last-mentioned flange 10 is denoted by symbol *7b*.

The central pin 5 consists of an electrically insulating, and preferably arc-resistant material. The intermediate electrode 8 consists at least in part of an arc-resistant material such as graphite. Graphite is preferred if sulphur hexafluoride ($SF_6$) is used as the quenching chamber gas.

A short-circuit ring 13 is located within the region of the intermediate electrode 8. The switching chamber 1 is filled with pressurized $SF_6$ gas with springs 14 being provided for the stationary switch part 6. A pair of threaded flanges are located between the chamber 1 and the flanges 10 respectively and further include switching chamber seals 19. An insulating part 17 faces the coil. Springs 18 are provided at the side of the sliding contact. The mode of operation of the invention will now be explained by use of the specific embodiment illustrated.

When the gas-switch is in the on-position, the movable switch part 9 engages the stationary switch part 6 as illustrated in reference to FIG. *2a*. To turn off the switch, the movable switch part 9 is moved in a downward direction as shown by an arrow 20. When the movable switch part 9 becomes detached from the stationary switch part 6, a commutating arc will occur across the two switch parts 6 and 9. Since the nozzle 9*a* of the movable switch part 9 is substantially still closed off by the central pin 5 at this time in the switching operation, the gas volume that is present between the central pin 5, the stationary switch part 6, designed in the form of a tulip-shaped contact, its insulating part 17, the intermediate electrode 8, and the movable switch part 9 (see FIG. *2a*) will be heated rapidly. Accordingly, the pressure within the gas volume will thereby greatly increase. This increase in pressure occurs at a minimum loss of energy even with a relatively small commutating arc. As the turn-off procedure continues, the movable switch part 9 continues downwardly and the commutating arc remains confined between the stationary switch part 6 and the central insulative pin 5.

In this way, the arc will be formed toward the intermediate electrode 8 by the flow of gas resulting from the small and rapidly heated gas volume and occurring between the stationary switch part 6 on the one side and the insulative pin 5 and the movable switch part 9 on the other side. The result of such an arrangement is that the arc will commutate at its end facing the insulative pin from the stationary switch part 6 to the intermediate electrode 8 and continue to burn as the commutated arc 21, across the intermediate electrode 8 and the movable switch part 9. In this way, the cut-off current is caused to flow through the coil 7. At the commutation specifically defined intermediate potentials do arise and it becomes possible to reduce a spacing between adjacent current—or voltage-carrying parts, such as the stationary switch part 6 and the intermediate electrode 8.

An object of the invention is facilitated due to the rapid commutation which will extend the service life of the stationary switch part 6. The central pin 5 consists of a one-piece insulative part which by means of projections 5*a* is also holding the fingers of the stationary switch part in place. In this way the use of insulating rings between the fingers nd the intermediate electrode 8 is unnecessary and the commutation of the arc is influenced in an advantageous manner.

The insulative pin 5 takes up the center area of the stationary switch piece 6, thereby dislodging the commutating arc from its region, and furthermore preventing a re-ignition at the stationary switch part 6 after the commutation. When the commutated arc 21 is arcing across the parts 8 and 9 and thereby actuates the coil 7, the arc 21 will begin to rotate under the influence of the coil field within the region of the intermediate electrode 8 as well as the free end of the insulative pin 5 while the other portion of the arc 21 takes up the central position illustrated in the drawing. The coil 7 is characterized here by its placement, namely being located as closely as possible within the commutation zone of the arc 21.

A positive pressure, relative to the gas pressure in the additional chamber 4, is generated in the arc chamber 3 due to the heating of the filling gas by the rotating arc portion. The length of the insulative pin 5 is selected in such manner that the aperture of the nozzle 9*a* will be released by the pin 5 only at the moment when a gas pressure sufficient for the forming of a quenching flow has been generated within the arc chamber 3.

With reference to FIGS. *2a* and *2b* an insulative pin 5' having a taper at its free end allows a gradual or partial opening of the nozzle 9*a*. Initially the opening of the nozzle 9*a* permits an inflow into the additional chamber 4 of any decomposition products produced by the arc. Thereafter the gradual opening of the nozzle 9*a* permits a more rapid and further increase of the pressure prior to the full release of the aperture of the nozzle 9*a*.

With reference now to FIG. *2c*, another insulative pin 5'' has only a partial taper at its free end with a profile of its free end increasing in such manner that the insulative pin 5'' in coordination with the movable switch part 9 will first provide during the opening of the gas switch a larger cross-sectional area of the nozzle 9*a* of the movable switch part 9 (see flow-indicating arrows 22 in FIG. *2c*).

In this way the gases produce at the commutation of the arc are allowed to enter the additional chamber 4, to be followed in the course of the further opening movement by the movable switch part 9 by a reduction in the obstructed area between the nozzle 9*a* and the insulative pin 5'' due to the increase in profile of the free end (see flow-indicating arrows 22 in FIG. *2d*). The decrease in cross section of the nozzle 9*a* provides an increase in the gas pressure prior to the full release of the front-facing aperture of the nozzle 9*a*.

Following the complete opening of the front-facing aperture of the nozzle 9*a* by the insulative pin 5'', the central portion of the arc 21 will be blasted length-wise and quenched by the quenching flow commencing through the nozzle 9*a* into the additional chamber 4. The placement of the short-circuit ring 13 leads to a phase shift of the magnetic field relative to the field-generating current, thereby improving the quenching effect.

The present invention as described in connection with the preferred embodiment are intended to be considered in all respects as illustrative and not as restrictive, the scope of the invention being indicated by the appended claims rather than by the foregoing description and all changes which come within the meaning and range of equivalency of the claims are therefore intended to be embraced therein.

What is claimed is:

1. An electric gas-switch, comprising:

a sealed switching chamber;

a partition which divides the switching chamber into an arc chamber and an additional chamber;

a central pin fixed within the arc chamber and having a free end, the central pin being of an electrically insulating material;

a first switch part stationary with respect to the switching chamber which at least partially embraces the central pin;

a coil which surrounds the first switch part and through which coil a cut-off current flows;

an annular intermediate electrode which surrounds the central pin at a distance and is in close proximity to the free end of the central pin; and a second switch part having a free end in the shape of a nozzle, the second switch part being movable with respect to the first, stationary switch part and having a plurality of apertures providing communication between the arc chamber and the additional chamber, the nozzle of the second switch part surrounding the free end of the central pin when the second switch part contacts the first switch part.

2. The electric gas-switch of claim 1, wherein the central pin tapers at least partially at the free end.

3. The electric gas-switch of claim 1, further comprising:

a short circuit ring which surrounds the central pin.

4. The electric gas switch of claim 1, wherein the nozzle of the second switch part tapers inwardly at the free end.

5. The electric gas-switch of claim 1, wherein the central pin is substantially cylindrical at the free end.

6. The electric gas-switch of claim 1 wherein the central pin tapers substantially inwardly and then outwardly in the vicinity of the free end.

7. The electric gas-switch of claim 1 wherein the intermediate electrode is made of graphite.

8. The electric gas-switch of claim 1 wherein a pressurized gas fills the switching chamber.

9. The electric gas-switch of claim 8 wherein the gas is sulfur hexaflouride.

* * * * *